US007266853B2

(12) United States Patent
Kasem

(10) Patent No.: US 7,266,853 B2
(45) **Date of Patent: *Sep. 11, 2007**

(54) CRIB HAVING MULTIPLE BASES

(76) Inventor: Jean Kasem, 138 N. Mapleton Dr., Los Angeles, CA (US) 90077

( * ) Notice: Subject to any disclaimer, the term of this patent is extended or adjusted under 35 U.S.C. 154(b) by 0 days.

This patent is subject to a terminal disclaimer.

(21) Appl. No.: 11/502,274

(22) Filed: Aug. 9, 2006

(65) Prior Publication Data

US 2006/0272091 A1 Dec. 7, 2006

Related U.S. Application Data

(63) Continuation of application No. 11/102,434, filed on Apr. 7, 2005, now Pat. No. 7,117,550.

(51) Int. Cl.
*A47D 7/00* (2006.01)

(52) U.S. Cl. ..... 5/93.2; 5/93.1; 5/8

(58) Field of Classification Search ..... 5/93.1, 5/93.2, 95, 902, 8

See application file for complete search history.

(56) References Cited

U.S. PATENT DOCUMENTS 2,563,752 A 8/1951 Rowland
2,569,574 A 10/1951 Parker
3,009,170 A 11/1961 Akram
4,046,421 A 9/1977 Spound et al.
4,953,246 A 9/1990 Matthews
5,787,524 A 8/1998 Butnik
D413,454 S 9/1999 Kasem
6,131,217 A 10/2000 Kasem
6,148,455 A 11/2000 Kasem

OTHER PUBLICATIONS

Internet, "Title 16—Commercial Practices, Chapter II—Consumer Product Safety Commission", Part 1509—Requirements for Non-Full-Size Baby Cribs—Table of Contents, Sec. 1509.2 Definitions, Code of Federal Regulations, Title 16, vol. 2, Revised Jan. 1, 2004, U.S. Government Printing Office via GPO Access (Cite: 16CFR 1509, p. 544) http://frwebgate5.access.gpo.gov/cgi-bin/waisgate.cgi?WAISdocID= 64222873669+5+0+0..., Feb. 28, 2005 (1 page).

(Continued)

*Primary Examiner*—Michael Trettel
(74) *Attorney, Agent, or Firm*—Blakely, Sokoloff, Taylor & Zafman LLP

(57) ABSTRACT

A crib has a base portion, base connector, crib side sections extending from the base portion and crib legs to support the base portion and the crib side sections above the ground. A front stationary crib side middle section, a back stationary crib side middle section and the base connector may be removed to reveal crib side openings and separate stationary crib side sections may be added to allow the crib to be converted into separate cribs.

21 Claims, 5 Drawing Sheets

OTHER PUBLICATIONS

Internet, "Title 16—Commercial Practices, Chapter II—Consumer Product Safety Commission", Part 1509—Requirements for Non-Full-Size Baby Cribs—Table of Contents, Sec. 1509.9 Mattresses, Code of Federal Regulations, Title 16, vol. 2, Revised Jan. 1, 2004, U.S. Government Printing Office via GPO Access (Cite: 16CFR1509, p. 545-546) http://frwebgate 5.access.gpo.gov/cgi-bin/waisgate.cgi?WAISdocID= 64222873669+7+0+0..., Feb. 28, 2005 (1 page).

Internet, "Title 16—Commercial Practices, Chapter II—Consumer Product Safety Commission", Part 1509—Requirements for Non-Full-Size Baby Cribs, Code of Federal Regulations, Title 16, vol. 2, Revised Jan. 1, 2004, U.S. Government Printing Office via GPO Access (Cite: 16CFR1509, p. 544-550) http://frwebgate5.access.gpo.gov/cgi-bin/waisgate.
cgi?WAISdocID=64222873669+1+0+0..., Feb. 28, 2005 (7 page).

Internet, "Title 16—Commercial Practices, Chapter II—Consumer Product Safety Commission", Part 1508—Requirements for Full-Size Baby Cribs, Code of Federal Regulations, Title 16, vol. 2, Revised Jan. 1, 2004, U.S. Government Printing Office via GPO Access (Cite: 16CFR1508, p. 537-543) http://frwebgate5.access.gpo.gov/cgi-bin/waisgate.
cgi?WAISdocID=64222873669+3+0+0..., Feb. 28, 2005 (6 page).

Internet page, Jeanne Kasem's Little Miss Liberty Round Crib Company, "Twin Cribs | Twin Cribs" 92-ITW Duetta CribMate, Little Miss Liberty Round Crib Company, California, USA, Feb. 28, 2005, http://www.crib.com/store/item.cfm?ItemID=814 &MainCatID=16&SubCatID=64 (2 pages).

"Round Twin Crib™ Assembly Instructions", Little Miss Liberty Round Crib Company, California, USA (5 pages).

Fax page, Double Delight™ Twin Crib, Nene, Jan. 28, 2005 (1 page).

Internet page, Twin Cots×2, PAMCO Quality Nursery Furniture, Christchurch, New Zealand, Feb. 28, 2005, http://www.pamco.co.nz/index.cfm/Cots/New_Generation/Twin_Cot.html(4 pages).

Internet home page, PAMCO Quality Nursery Furniture, Christchurch, New Zealand, Jan. 26, 2005, http://www.pamco.co.nz/ (4 pages).

CRIB HAVING MULTIPLE BASES

This application is a continuation of Ser. No. 11/102,434, filed Apr. 7, 2005, entitled "Crib Having Moveable and Stationary Sides, Multiple Bases, and a Base Connector, now U.S. Pat. No. 7,117,550".

BACKGROUND

1. Field

The embodiments of the invention relate to cribs and, in one embodiment, to converting a single twin crib into two separate cribs.

2. Background

Cribs of varying shapes and sizes provide a safe and comfortable sleeping area for infants. Standard cribs generally have a base to support a mattress, legs to raise the base to a desired height off the floor and crib sides with vertically extending bars to prevent the infant from falling off of the mattress. For the safety and comfort of the infant, the crib bars are spaced dose enough so that the infant's head cannot fit in between the bars yet far enough apart to allow the infant to see out of the crib. Standard cribs are sized to accommodate one infant. An example is the round crib by Little Miss Liberty Crib Company, Los Angeles, Calif. Thus, in the case where a parent has multiple infants, more than one standard crib may be purchased to accommodate each infant. In U.S. Pat. No. 5,787,524, a crib for more than one infant is described as having multiple sleeping areas. That crib has two sleeping areas whose longitudinal axes intersect at a right angle. Another vendor, PAMCO Nursery Furniture of New Zealand, has a twin cot that converts to two "King Single Beds."

BRIEF DESCRIPTION OF THE DRAWINGS

Various embodiments are illustrated by way of example and not by way of limitation in the figures of the accompanying drawings in which like references indicate similar elements. It should be noted that different references to "an," "one," or "various" embodiments in this disclosure are not necessarily to the same embodiment, and such references mean at least one.

DETAILED DESCRIPTION

In this section we shall explain several preferred embodiments of this invention with reference to the appended drawings. Whenever the shapes, relative positions and other aspects of the parts described in the embodiments are not clearly defined, the scope of the invention is not limited only to the parts shown, which are meant merely for the purpose of illustration.

Figure 1:
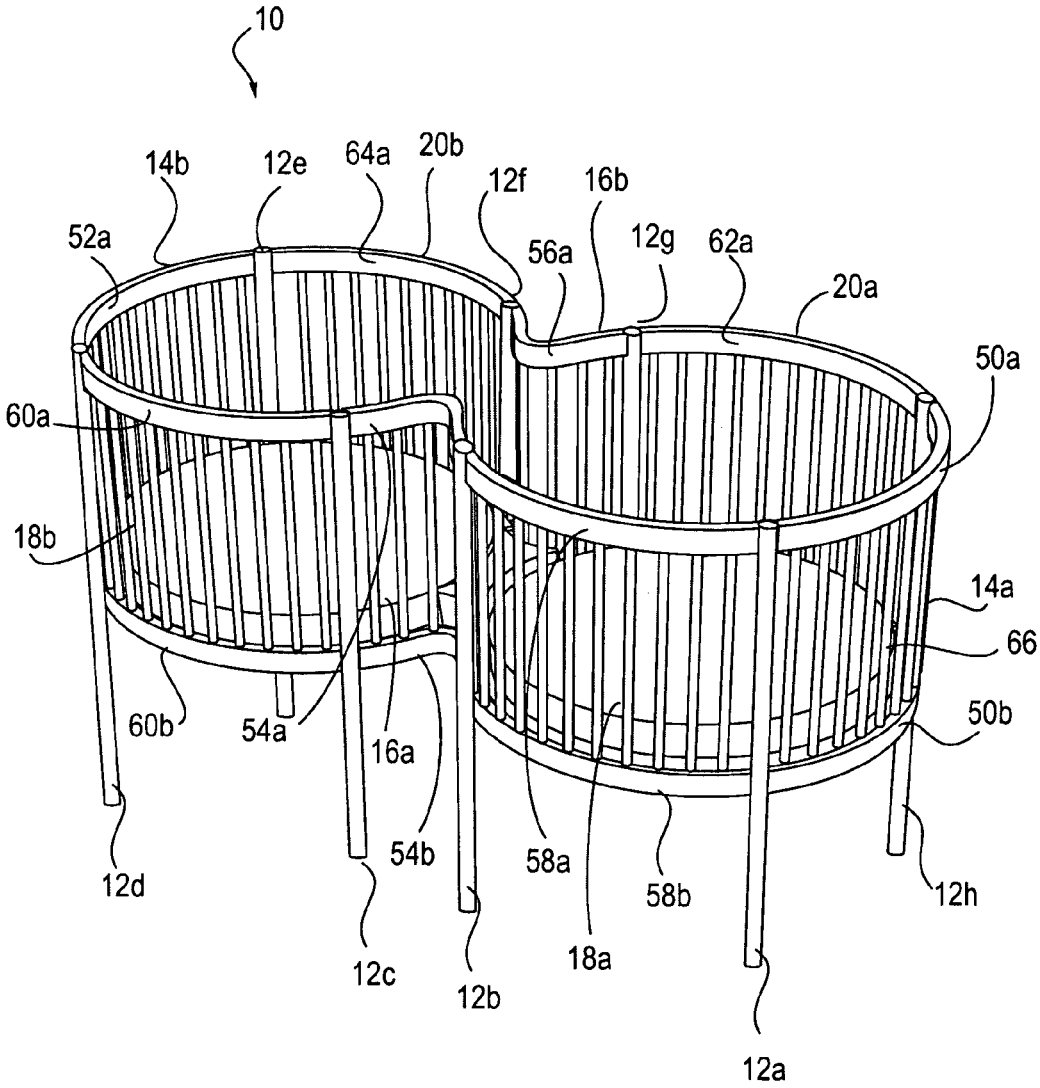
FIG. 1 illustrates a perspective view of the crib according to an embodiment of the invention.

FIG. 1 is an illustration of one embodiment of a crib for more than one infant. The crib may be assembled to allow the infants to move from one section of the crib to another. In another embodiment, the crib may be assembled into two separate, smaller cribs.

In one embodiment, the crib 10 may have a base portion, crib side sections and crib legs for supporting the base portion and the crib side sections above the ground. The base portion, the crib side sections and the crib legs may be assembled to provide a comfortable area for infants to sleep or play without constant adult supervision. The crib parts may be of any materials and may be assembled in compliance with the crib safety regulations set forth by the United States Consumer Product Safety Commission in the Code of Federal Regulations. In one embodiment, referring now to FIG. 2, the base portion may have a first base 22*a* and a second base 22*b* connected to each other by a base connector 24. The base connector 24, the first base 22*a* and the second base 22*b*, once assembled as shown, are preferably planar such that the base portion has a top surface that is all within the same plane. The first base 22*a* and the second base 22*b* are preferably essentially identical, and the base connector 24 perimeter conforms to the shapes on either side of it. When the first base 22*a*, the second base 22*b* and the base connector 24 are shaped in the preferred manner shown, the perimeter of the base portion is shaped essentially like a figure eight. As an alternative, the perimeter of the base can be of a different shape (such as rectangular), and the base connector in that case would have a perimeter that conforms to the straight sides of the two bases. The first base 22*a* may be secured to the base connector 24 by inserting a bolt through one side of the base connector 24 and one side of the first base 22*a*. The other side of the base connector 24 may then be secured to the second base 22*b* by a similar fastening mechanism. In another embodiment, the base connector 24 may be removed so that each of the first base 22*a* and the second base 22*b* may be used as a base for the smaller cribs. In still another embodiment, the base portion may have additional bases and base connectors coupled to each other in sequence.

In one embodiment, a plurality of crib side sections may extend from the base portion. When the first base 22*a* and the second base 22*b* are connected by the base connector 24, the crib side sections may extend from the perimeter of the first base 22*a*, the second base 22*b* and the base connector 24. The crib side sections may be of a height (above the base portion) that prevents an infant from climbing over the crib side sections. The crib side sections may be of the same size and shape. Thus, when the dimensions of one crib side section are determined, the remaining crib side sections may be efficiently manufactured by duplicating the crib side section. When the first base 22*a* and the second base 22*b* are curved (e.g., circular as shown in the figures), the crib side sections may be shaped to conform to the perimeter of the base portion such that the crib appears as two connected round cribs in a side by side configuration. This is in contrast to arranging two standard cribs in a stacked configuration with one crib positioned above the other. In the configuration shown in FIG. 1, the two cribs are symmetrical. Thus, once the dimensions of a first crib are determined, the second crib may be manufactured advantageously by merely duplicating the dimensions of the first crib.

Figure 5:
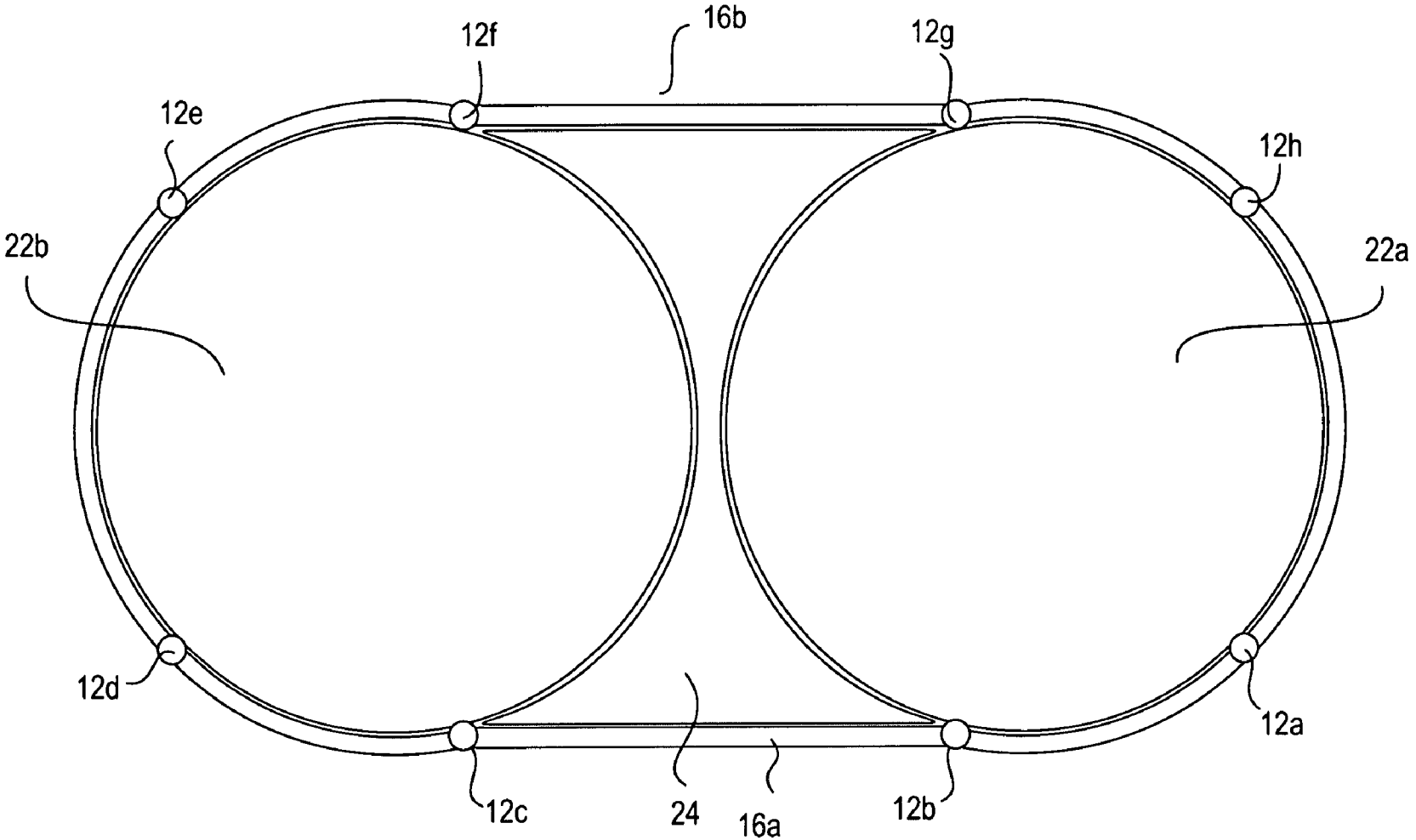
FIG. 5 illustrates a top view of the crib base portion according to an embodiment of the invention.

In one embodiment, a front stationary crib side middle section 16*a* may extend vertically from the base portion. In the example shown, the front stationary crib side middle section 16*a* also runs horizontally along portions of the sides of the first base 22*a*, the second base 22*b* and the base connector 24. As an alternative, the middle section 16*a* may conform essentially only to the base connector's perimeter, if the base connector 24 is deep enough (such as shown in FIG. 5). The front stationary crib side middle section 16*a* may have a horizontal top rail 54*a* and a horizontal bottom rail 54*b*. A number of bars 66 may extend vertically between and are permanently attached to the top rail 54*a* and the bottom rail 54*b*. The bars 66 may be spaced at distances from each other to prevent a child's head from fitting between the bars 66, and to allow the child lying in the crib to be easily seen from outside the crib.

The front stationary crib side middle section 16*a* is preferably curved as shown (conforming to the front side of the base connector 24), so as not to present any sharp angles to the child inside the crib.

The bottom rail 54*b* may be secured to portions of the first base 22*a*, the second base 22*b* and the base connector 24. Any acceptable securing mechanism, such as bolts, nails, screws or brackets, may be used to secure the bottom rail 54*b* to the first base 22*a*, the second base 22*b* and the base connector 24. In one embodiment, the front stationary crib side middle section 16*a* may be removed from the base portion so that the crib may be converted into two separate cribs.

In one embodiment, a back stationary crib side middle section 16*b* may extend from the base portion, at a location that is directly opposite the front middle section 16*a*. The back stationary crib side middle section 16*b* may conform to the perimeter of the first base 22*a*, the second base 22*b* in FIG. 3 and the base connector 24 as shown. The back stationary crib side middle section 16*b* may be preferably of the same shape and size as the front stationary crib side middle section 16*a* such that one may be used in place of the other. The back stationary crib side middle section 16*b* may have a horizontal top rail 56*a* and a horizontal bottom rail 56*b*. Bars 66 may extend vertically between and may be permanently attached to the top rail 56*a* and the bottom rail 56*b*. In one embodiment, the bottom rail 56*b* may be secured to portions of the first base 22*a*, the second base 22*b* and the base connector 24 that are directly opposite those to which the bottom rail 56*a* may be attached. Any acceptable securing mechanism, such as bolts, nails, screws or brackets, may be used to secure the bottom rail 56*b* to the first base 22*a*, the second base 22*b* and the base connector 24. In one embodiment, the back stationary crib side middle section 16*b* may be removed from the base portion so that the crib may be converted into two separate cribs.

The back stationary crib side middle section 16*b* is preferably curved as shown (conforming to the back side of the base connector 24), so as not to present any sharp angles to the child inside the crib.

A first movable crib side section 18*a* may extend vertically from the base portion. In one embodiment, the first movable crib side section 18*a* is a separate piece located adjacent to the first base 22*a* and runs (horizontally) along a part but not all of the complete perimeter of the base 22*a*. In the example shown, the section 18*a* cuts an arc of about ninety degrees around the complete circle defined by the perimeter of the base 22*a*. The first movable crib side section 18*a* may have a horizontal top rail 58*a* and a horizontal bottom rail 58*b*. A plurality of bars 66 may extend vertically between and are permanently attached to the top rail 58*a* and the bottom rail 58*b*. In another embodiment, the plurality of bars 66 may be positioned in any direction between the top rail 58*a* and the bottom rail 58*b*. The bars 66 may be spaced at any distance from each other sufficient to prevent a child's head from fitting between the bars 66, and to allow the child lying in the crib to easily see outside the crib all around herself. The bottom rail 58*b* may be secured to the base portion. The bottom rail 58*b* may preferably be secured to the first base 22*a*. Any acceptable securing mechanism, such as bolts, nails, screws or brackets may be used to secure the bottom rail 58*b* to the base portion.

A second movable crib side section 18*b* may extend vertically from the base portion. In one embodiment, the second movable crib side section 18*b* is a separate piece located adjacent to the second base 22*b* and runs (horizontally) along a part but not all of the complete perimeter of the base 22*b*. In the example shown, the section 18*b* cuts an arc of about ninety degrees around the complete circle defined by the perimeter of the base 22*b*. The second movable crib side section 18*b* may be preferably of the same shape and size as the first movable crib side section 18*a* such that one may be used in place of the other. In one embodiment, the second movable crib side section 18*b* may have a horizontal top rail 60*a* and a horizontal bottom rail 60*b*. A plurality of bars 66 may extend vertically between and are permanently attached to the top rail 60*a* and the bottom rail 60*b*. In another embodiment, the plurality of bars 66 may be positioned in any direction between the top rail 60*a* and the bottom rail 60*b*. The bars 66 may be spaced at any distance from each other sufficient to prevent a child's head from fitting between the bars 66. The bottom rail 60*b* may be secured to the base portion. The bottom rail 60*b* may preferably be secured to the second base 22*b*. Any acceptable securing mechanism, such as bolts, nails, screws or brackets may be used to secure the bottom rail 50*b* to the base portion.

A first stationary crib side end section 14*a* may extend vertically from the base portion. In one embodiment, the first stationary crib side end section 14*a* is a separate piece located adjacent to the first base 22*a* and runs (horizontally) along a part but not all of the complete perimeter of the base 22*a*. In the example shown, the section 14*a* cuts an arc of about ninety degrees around the complete circle defined by the perimeter of the base 22*a*. The first stationary crib side end section 14*a* may be of the same shape and size as the movable sections 14*a*, 14*b*. The first stationary crib side end section 14*a* may have a horizontal top rail 50*a* and a horizontal bottom rail 50*b*. A plurality of bars 66 may extend vertically between the top rail 50*a* and the bottom rail 50*b*. In another embodiment, the plurality of bars 66 may be positioned in any direction between the top rail 50*a* and the bottom rail 50*b*. The bars 66 may be spaced at distances from each other to prevent a child's head from fitting between the bars 66, and to meet other useful features described above including full view of the outside by the child lying in the crib, as well as full view by those outside the crib. The bottom rail 50*b* may be secured to the base portion. The bottom rail 50*b* may preferably be secured to the first base 22*a*. Bolts, nails, screws, brackets or any other similar securing mechanism may be used to secure the bottom rail 50*b* to the base portion.

A second stationary crib side end section 14*b* may extend vertically from the base portion. In one embodiment, the second stationary crib side end section 14*b* is a separate piece located adjacent to the second base 22*b* and runs (horizontally) along a part but not all of the complete perimeter of the base 22*b*. In the example shown, the section 14*b* cuts an arc of about ninety degrees around the complete circle defined by the perimeter of the base 22*b*. The second stationary crib side end section 14*b* may be preferably of the same shape and size as the first stationary crib side end section 14*a* such that one may be used in place of the other. The second stationary crib side end section may have a horizontal top rail 52*a* and a horizontal bottom rail 52*b*. A plurality of bars 66 may extend vertically between the top rail 52*a* and the bottom rail 52*b*. In another embodiment, the plurality of bars 66 may be positioned in any direction between the top rail 52*a* and the bottom rail 52*b*. The bars 66 may be spaced at distances from each other to prevent a child's head from fitting between the bars 66. The bottom rail 52*b* may be secured to the base portion. The bottom rail 52*b* may preferably be secured to the second base 22*b*. Bolts, nails, screws, brackets or any other similar securing mechanism may be used to secure the bottom rail 52*b* to the base portion.

A first crib side back section 20*a* may extend vertically from the base portion. In one embodiment, the first crib side back section 20*a* is a separate piece located adjacent to the first base 22*a* and runs (horizontally) along a part but not all of the complete perimeter of the base 22*a*. In the example shown, the section 20*a* cuts an arc of about ninety degrees around the complete circle defined by the perimeter of the base 22*a*. The first crib side back section 20*a* may be of the same shape and size as the movable and end crib side sections 14*a*, 14*b*, 18*a*, 18*b*. The first crib side back section may have a horizontal top rail 62*a* and a horizontal bottom rail 62*b*. A plurality of bars 66 may extend vertically between the top rail 62*a* and the bottom rail 62*b*. In another embodiment, the plurality of bars 66 may be positioned in any direction between the top rail 62*a* and the bottom rail 62*b*. The bars 66 may be spaced at distances from each other to prevent a child's head from fitting between the bars 66. The bottom rail 62*b* may be secured to the base portion. The bottom rail 62*b* may preferably be secured to the first base 22*a*. Bolts, nails, screws, brackets or any other similar securing mechanism may be used to secure the bottom rail 62*b* to the base portion. In one embodiment, the first crib side back section 20*a* may be movable.

A second crib side back section 20b may extend vertically from the base portion. In one embodiment, the second crib side back section 20*a* is a separate piece located adjacent to the second base 22*b* and runs (horizontally) along a part but not all of the complete perimeter of the base 22*b*. In the example shown, the section 22*b* cuts an arc of about ninety degrees around the complete circle defined by the perimeter of the base 22*b*. The second crib side back section 20*b* may be preferably of the same shape and size as the first crib side back section 20*a* such that one may be used in place of the other. The second crib side back section 20*b* may have a horizontal top rail 64*a* and a horizontal bottom rail 64*b*. A plurality of bars 66 may extend vertically between the top rail 64*a* and the bottom rail 64*b*. In another embodiment, the plurality of bars 66 may be positioned in any direction between the top rail 64*a* and the bottom rail 64*b*. The bars 66 may be spaced at distances from each other to prevent a child's head from fitting between the bars 66. The bottom rail 64*b* may be secured to the base portion. The bottom rail 64*b* may preferably be secured to the second base 22*b*. Bolts, nails, screws, brackets or any other similar securing mechanism may be used to secure the bottom rail 64*b* to the base portion. In one embodiment, the second crib side back section 20*b* may be movable.

In one embodiment, the crib legs 12*a*, 12*b*, 12*c*, 12*d*, 12*e*, 12*f*, 12*g*, 12*h* may be adjacent to the base portion. The crib legs may be preferably of the same shape and size such that they support the base portion evenly above the floor. The crib legs 12*a*, 12*b*, 12*g*, 12*h* may be secured to the perimeter of the first base 22*a*. The crib legs 12*c*, 12*d*, 12*e*, 12*f* may be secured to the perimeter of the second base 22*b*. In one embodiment, a set of holes 38, 40, 42 may be formed in the crib legs 12*a-h* so the base portion may be secured to the crib legs 12*a-h* at various heights to allow the parent to adjust the distance between the base portion and the top rail of the crib side sections. Bolts, nails, screws, brackets or any other similar securing mechanism may be used to secure the crib legs 12*a-h* to the base portion and crib side sections.

In one embodiment, the crib legs 12*a-h* may be adjacent to the crib side sections. The crib legs 12*a-h* may be secured to their adjacent crib side sections. The crib legs 12*a-h* may be secured to the top rail and the bottom rail only of an adjacent crib side section. In still another embodiment, the crib legs 12*a-h* may be secured to a vertically extending bar positioned between a top rail and a bottom rail of an adjacent crib side section.

In one embodiment, the crib side sections may be adjacent to one another such that a crib in the shape of two side by side cribs is formed. In one embodiment, one end of the first stationary crib side end section 14*a* may be adjacent to one end of the first movable crib side section 18*a*. One end of the second stationary crib side end section 14*b* may be adjacent to one end of the second movable crib side section 18*b*. One end of the front stationary crib side middle section 16*a* may be adjacent to another end of the first movable crib side section 18*a*. Another end of the front stationary crib side middle section 16*a* may be adjacent to another end of the second movable crib side section 18*b*. One end of the back stationary crib side middle section 16*b* may be adjacent to one end of the first crib side back section 20*a*. Another end of the back stationary crib side middle section 16*b* may be adjacent to one end of the second crib side back section 20*b*. Another end of the first stationary crib side end section 14*a* may be adjacent to another end of the first crib side back section 20*a*. Another end of the second stationary crib side end section 14*b* may be adjacent to another end of the second crib side back section 20*b*.

In one embodiment, the crib legs 12*a-h* may be secured to adjacent crib side sections. Any securing mechanism, such as bolts, nails, screws or brackets, may be used to secure the crib legs 12*a-h* to adjacent crib side sections. In one embodiment, one end of the first stationary crib side end section 14*a* and one end of the first movable crib side section 18*a* may be secured to a crib leg 12*a*. One end of the second stationary crib side end section 14*b* and one end of the second movable crib side section 18*a* may be secured to a crib leg 12*d*. One end of the front stationary crib side middle section 16*a* and another end of the first movable crib side section 18*a* may be secured to a crib leg 12*b*. Another end of the front stationary crib side middle section 16*a* and another end of the second movable crib side section 18*b* may be secured to a crib leg 12*c*. One end of the back stationary crib side middle section 16*b* and one end of the second crib side back section 20*b* may be secured to a crib leg 12*f*. Another end of the back stationary crib side middle section 16*b* and one end of the first crib side back section 20*a* may be secured to a crib leg 12*g*. Another end of the first stationary crib side end section 14*a* and another end of the first crib side back section 20*a* may be secured to a crib leg 12*h*. Another end of the second stationary crib side end section 14*b* and another end of the second crib side back section 20*b* may be secured to crib leg 12*e*. In another embodiment where the crib is in a stacked configuration, crib legs 12*c*, 12*d*, 12*e*, 12*f* and the adjacent crib side sections are positioned on top of crib legs 12*a*, 12*b*, 12*g*, 12*h* and the adjacent crib side sections.

Figure 2:
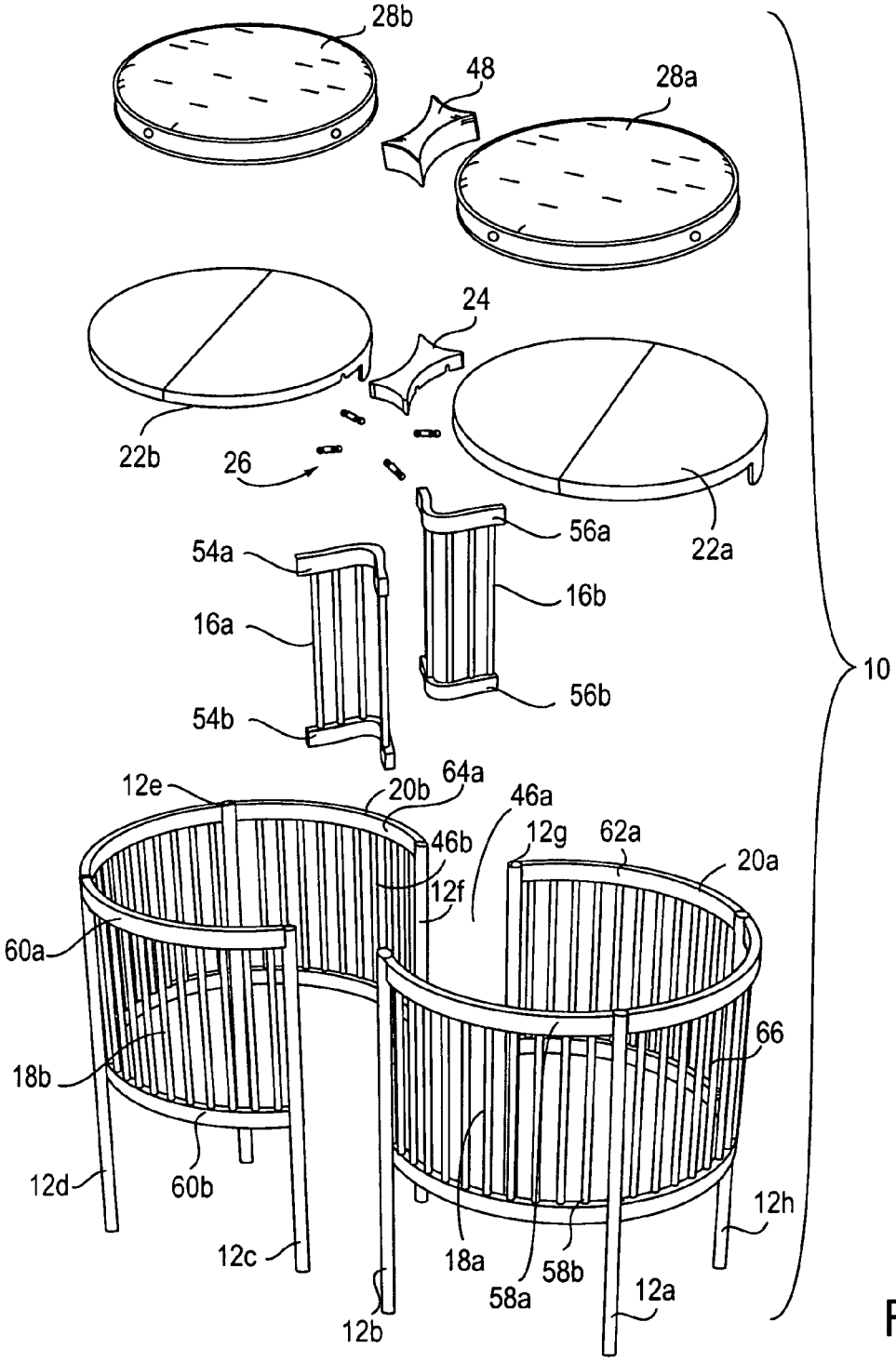
FIG. 2 illustrates a perspective view of the crib being converted into two separate cribs.

FIG. 2 is an illustration of a further embodiment of the crib. In this embodiment, the crib is shown being converted into two separate cribs. In this illustration, one end of the front stationary crib side middle section 16*a* is shown removed from crib leg 12*c*. The second movable crib side section 18*b* remains secured to crib leg 12*c*. Another end of the front stationary crib side middle section 16*a* is shown removed from crib leg 12*b*. The first movable crib side section 18*a* remains secured to crib leg 12*b*. One end of the back stationary crib side middle section 16*b* is shown removed from crib leg 12*f*. The second crib side back section 20*b* remains secured to crib leg 12*f*. Another end of the back stationary crib side middle section 16*b* is shown removed from crib leg 12*g*. The first crib side back section 20*a* remains secured to crib leg 12*g*. The crib side middle sections 16*a*, 16*b* may then be removed from the crib legs 12*b*, 12*c*, 12*f*, 12*g* and adjacent base portion to form a first and second crib side openings 46*a*, 46*b*. The base connector 24 that is coupled to the first base 22*a* and the second base 22*b* of the base portion may further be removed. The crib side openings 46*a*, 46*b* may then be closed with separate stationary crib side sections (not shown). This action results in each base being so that two smaller cribs are formed. The separate stationary crib side sections may be completely surrounded by crib side sections, preferably of the same size and shape as the stationary crib side sections previously discussed. Horizontal rails of the stationary crib side sections may be secured to the adjacent crib legs 12*b*, 12*c*, 12*f*, 12*g*. Any type of fastener or securing mechanism, such as bolts, nails, screws or brackets may run along the length of the crib legs and be used to secure the crib side sections 16*a*, 16*b*, 18*a*, 18*b*, 20*a*, 20*b* to crib legs 12*b*, 12*c*, 12*f*, 12*g*.

In one embodiment, a mattress is provided to cushion the infant sleeping area. A illustrated in FIG. 2, a set of mattresses 28*a*, 28*b* may be positioned on top of the base portion. The set of mattresses may have a first mattress 28*a* with a perimeter matching that of the first base 22*a*. The first mattress 28*a* may be positioned on top of the first base 22*a*. The set of mattresses may further have a second mattress 28*b* with a perimeter matching that of the second base 22*b*. The second mattress 28*b* may be positioned on top of the second base 22*b*. The first mattress 28*a* and the second mattress 28*b* may preferably have matching perimeters such that they may be used interchangeably. The set of mattresses may have a third mattress 48 with a perimeter matching that of the base connector 24. The third mattress 48 may fit between the first mattress 28*a* and the second mattress 28*b* so that it may be positioned on top of the base connector 24. The set of mattresses may be removable from the base portion. In the embodiment where the first base 22*a* and the second base 22*b* are separated, the first mattress 28*a* and the second mattress 28*b* may be used to cushion the first base 22*a* and the second base 22*b*.

Figure 3:
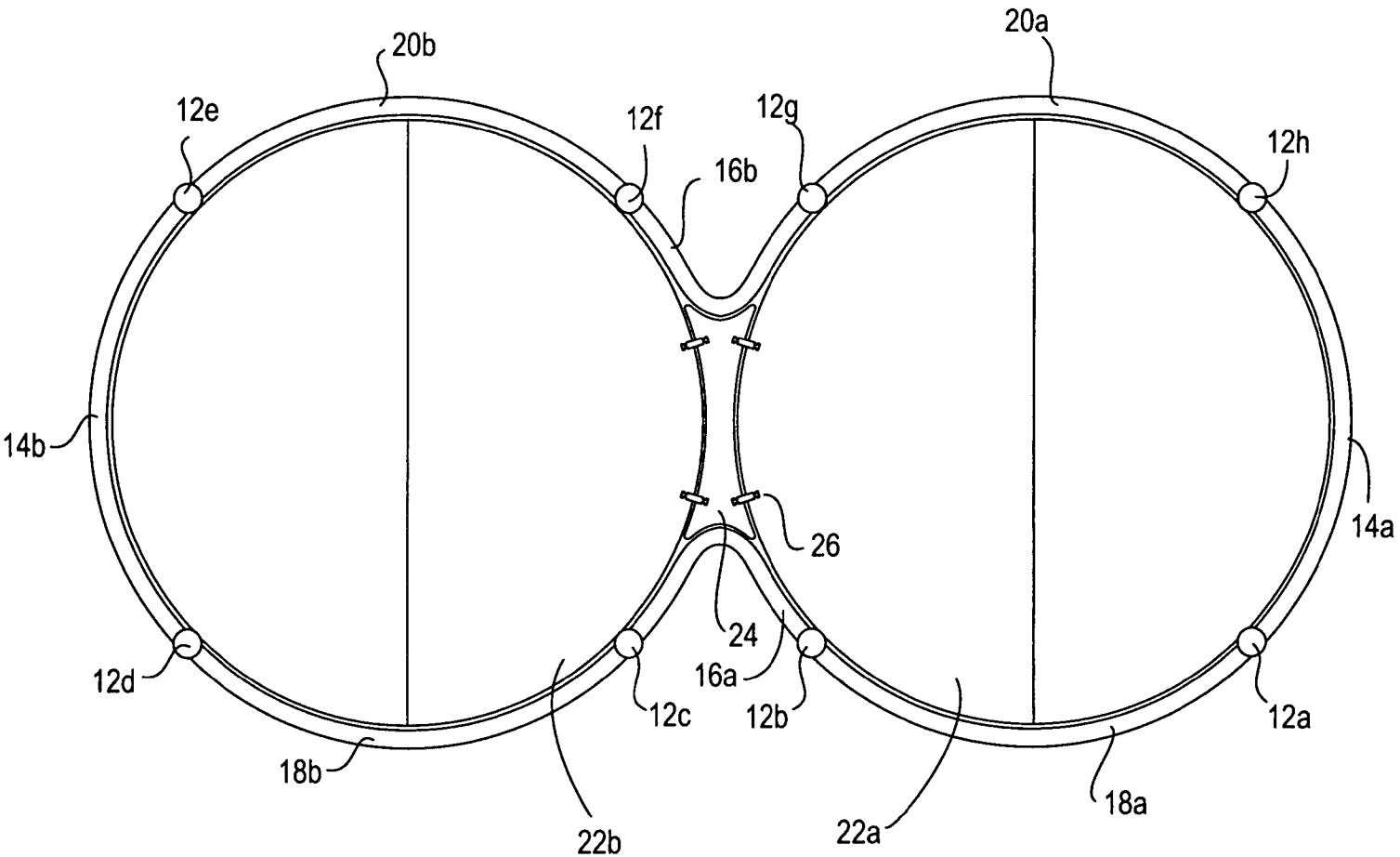
FIG. 3 is a top view of the crib base portion according to an embodiment of the invention.

FIG. 3 is an illustration of a further embodiment of the crib. In this embodiment, the base portion of the crib is shown. The first base 22*a* is secured to one side of the base connector 24 and the second base 22*b* is secured to another side of the base connector 24. As shown in FIG. 2, the base connector 24 may be secured to the first base 22*a* and the second base 22*b* with bolts 26, nails, screws, brackets or any other similar securing mechanism. The crib legs 12*a-h* are also shown secured to the perimeter of the base portion and adjacent crib side sections.

Figure 4:
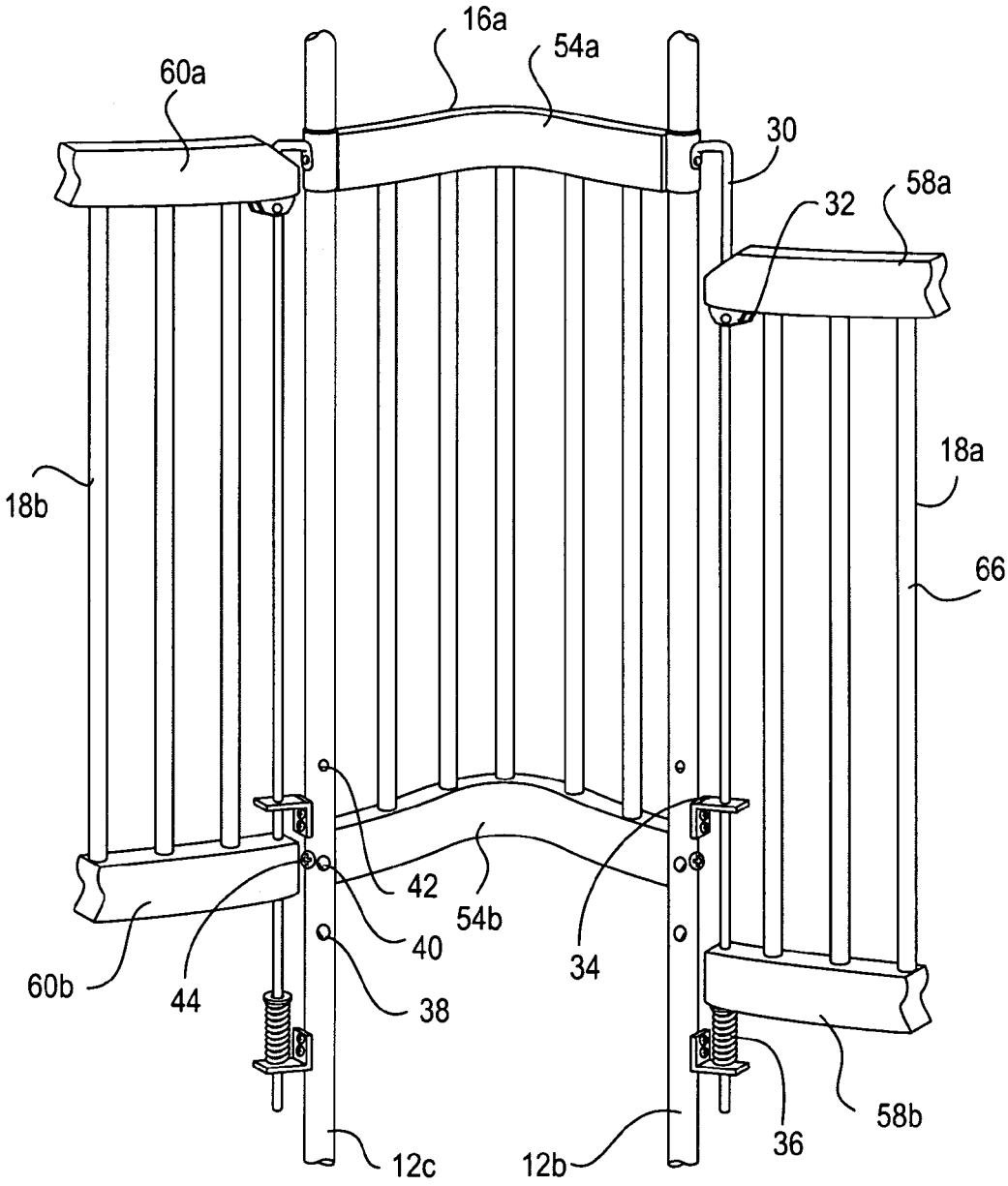
FIG. 4 illustrates a perspective view of an arrangement of the crib side sections according to an embodiment of the invention.

FIG. 4 is an illustration of a further embodiment of the crib. In this embodiment, the crib side sections are shown adjacent to one another. In one embodiment, adjacent crib side sections may be movable in a vertical direction. The first movable crib side section 18*a* and the second movable crib side section 18*b* may be movable in the vertical direction. In the embodiment shown, each movable crib side section 18*a*, 18*b* is guided by a pair of rods 30 that extend vertically through either side of the movable side members 18*a*, 18*b*. The top portion of the rod 30 is looped to return downwards and connects to a portion of the crib, preferably the crib legs 12*b*, 12*c*, which are stationary with respect to the movable crib side sections 18*a*, 18*b*. A rail connector bolt 44 may be used to attach the crib legs 12*b*, 12*c*, to the ends of the front stationary crib side middle section 16*a* through a flat end of the rod 30. There are alternatives to the use of the angled rod 30 that also permit easy access to the child in the crib. For instance, a vertical track attached to the side of the crib legs may be used to allow the crib side sections to slide up and down. An alternative to the rod and the track which are external to the crib legs is a groove formed inside the crib leg. The groove guides a dowel, which is attached to the side member and protrudes horizontally to engage the groove. An alternative to the vertically moving side members is to have a top portion of the side member be hinged like a door, allowing a lower access to the inside of the crib after being rotated open.

FIG. 5 is an illustration of an alternative embodiment of the crib. In this embodiment, the base portion of the crib is shown. The first base 22*a* is secured to one side of the base connector 24 and the second base 22*b* is secured to another side of the base connector 24. In this embodiment, the crib side middle sections 16*a*, 16*b* are shown conforming essentially only to the perimeter of the base connector 24 when the base connector 24 is deep enough. Thus, when the base connector 24 is deep enough, the crib side middle sections 16*a*, 16*b* are positioned essentially only on top of the base connector 24. The crib legs 12*b*, 12*c*, 12*f*, 12*g* may be adjacent to the base connector 24 and the first and second bases 22*a*, 22*b*. The crib legs 12*b*, 12*c* may be secured to the same side of the base connector 24. The crib legs 12*f*, 12*g* may be secured to the same side of the base connector 24. The crib legs 12*b*, 12*c*, 12*f*, 12*g* are also shown secured to the perimeter of the base portion and adjacent crib side sections at the points where the first and second bases 22*a*, 22*b* meet the base connector 24. As shown in FIG. 2, the base connector 24 may be secured to the first base 22*a* and the second base 22*b* with bolts, nails, screws, brackets or any other similar securing mechanism. The base connector 24 may be secured to the crib legs 12*b*, 12*c*, 12*f*, 12*g* and the crib side middle sections 16*a*, 16*b* with bolts, nails, screws, brackets or any other similar securing mechanism.

In an alternative embodiment, the crib 10 may have a canopy assembly as described in U.S. Pat. No. 6,148,455 issued to Jean Kasem entitled "METHOD AND APPARATUS FOR CONVERTING A CANOPY CRIB TO A STANDARD CRIB." The canopy may be of a variety of shapes, including flat, concave, or cone. The frame for supporting the canopy can be attached, using the techniques described in the '455 patent, to a number of canopy legs. The canopy legs may in turn be removably connected to the crib, and in particular to the crib legs. Note how the manner in which adjacent base portions are connected (FIG. 1) allows a canopy to be attached above each base, advantageously without having to modify the supporting frame or the crib legs.

In the foregoing specification, the invention has been described with reference to specific embodiments thereof. It will, however, be evident that various modifications and changes can be made thereto without departing from the broader spirit and scope of the invention as set forth in the appended claims. For example, in one embodiment the movable crib side sections may be secured to a crib leg with a hinge such that the movement of the movable crib side sections may be similar to that of a hinged door. The specification and drawings are, accordingly, to be regarded in an illustrative rather than a restrictive sense.

The invention claimed is:

1. A crib comprising:

a first base, a first movable crib side section and a first stationary crib side end section, one end of the first stationary crib side end section is adjacent to one end of the first movable crib side section, and a first crib side back section extending from the first base;

a second base, a second movable crib side section and a second crib side back section extending from the second base;

a front stationary crib side middle section having one end adjacent to another end of the first movable crib side section and another end adjacent to another end of the second movable crib side section;

a back stationary crib side middle section having one end adjacent to one end of the first crib side back section and another end that is adjacent to one end of the second crib side back section; and a base connector coupled in between the first base and the second base such that the centers of the first base, the second base and the base connector are in alignment with one another.

2. The crib of claim 1, wherein the front stationary crib side middle section, the back stationary crib side middle section and the base connector are removable to convert the crib into at least two separate cribs each of which has a crib side opening between the movable crib side section and the crib side back section that is to be closed with a further stationary crib side section.

3. The crib of claim 1, further comprising a plurality of crib legs connected to the first base and the second base to raise the first base and the second base off the ground and each leg positioned between two adjacent crib side sections wherein the front stationary crib side middle section is secured to respective crib legs at its opposite ends.

4. The crib of claim 3, wherein the one end of the first crib side back section and the one end of the back stationary crib side middle section are secured to a respective crib leg, and the other end of the back stationary crib side middle section and the one end of the second crib side back section are secured to a respective crib leg.

5. The crib of claim 1, further comprising:

a first mattress whose perimeter matches that of the first base, a second mattress whose perimeter matches that of the second base, and a third mattress whose perimeter matches that of the base connector.

6. The crib of claim 1, wherein each crib side section comprises:

a plurality of vertical, elongated bars spaced around its base to prevent a child lying on the base from removing herself from the base.

7. The crib of claim 1, further comprising:

a set of angled rods wherein an angled rod extends vertically through each of the first movable crib side section and the second movable crib side section for guiding the movable crib side sections in a vertical direction.

8. The crib of claim 3, further comprising a set of holes in each crib leg for connecting the base portion to each leg at various positions along the crib legs.

9. A kit of parts for a crib, comprising:

a base portion having a first base, a second base, and a base connector, a portion of the first base and a portion of the second base to be adjacent to opposite ends of the base connector when assembled;

a plurality of crib side sections to surround the base portion, the crib side sections comprised of a first movable section, and a first back section, a second movable section, and a second back section, a front stationary middle section having one end adjacent to another end of the first movable crib side section and another end adjacent to another end of the second movable crib side section, a back stationary middle section having one end adjacent to one end of the first back section and another end that is adjacent to one end of the second back section; and a plurality of crib legs each to be positioned between two adjacent crib side sections and wherein the one end of the front stationary middle section and the another end of the first movable section are secured to the same crib leg, the another end of the front stationary middle section and the another end of the second movable section are secured to the same crib leg, the one end of the back stationary middle section and the one end of the first back section are secured to the same crib leg, and the another end of the back stationary middle section and the one end of the second back section are secured to the same crib leg.

10. The kit of claim 9, wherein the front stationary middle section and the back stationary middle section are to be positioned adjacent to opposite ends of the base connector.

11. The kit of claim 9, wherein the perimeter of the base connector has opposite portions each of which conforms to a respective adjacent portion of the perimeter of the first and the second bases, and a top surface of the base connector is within the same plane as a top surface of each base.

12. The kit of claim 9, wherein the kit further comprises a conversion kit for converting the crib into at least two separate cribs each of which has a crib side opening between the movable section and the back section that is to be closed with a further stationary section.

13. The kit of claim 9, wherein each crib side section comprises:

a plurality of evenly spaced vertical elongated bars spaced around its base portion to prevent a child lying on the base portion from removing herself from the crib.

14. The kit of claim 9, wherein the plurality of crib legs are to be connected to the base portion.

15. The kit of claim 9, wherein fasteners selected from one of a bolt, nail, screw, bracket and hinge are to secure the crib side sections to the crib legs.

16. The kit of claim 9, further comprising:

a canopy; and a plurality of canopy legs for being connected to the canopy at one end and for being removably coupled to an upper portion of the crib legs near another end.

17. The kit of claim 9, further comprising:

a set of angled rods wherein an angled rod extends vertically through each of the first movable section and the second movable section for guiding the movable sections in a vertical direction.

18. The kit of claim 9, further comprising:

a set of mattresses wherein a first mattress whose perimeter matches that of the first base is to be positioned on top of the first base, a second mattress whose perimeter matches that of the second base is to be positioned on top of the second base, and a third mattress whose perimeter matches that of the base connector is to be positioned on top of the base connector.

19. A method for converting a crib into at least two separate cribs comprising:

forming a first crib side opening by removing one end of a front stationary crib side middle section from a crib leg secured to a second movable crib side section, and another end from a crib leg secured to a first movable crib side section wherein the crib legs are secured to the movable crib side sections by fasteners spaced along the length of the crib legs;

forming a second crib side opening by removing one end of a back stationary crib side middle section from a crib leg secured to a second crib side back section, and another end of the back stationary crib side middle section from a crib leg secured to a first crib side back section wherein the crib legs are secured to the crib side back sections by fasteners spaced along the length of the crib legs;

removing a base connector that is coupled between a first base and a second base of the crib; and securing separate stationary crib side sections to at least one of the bases and the crib legs with fasteners to create at least two separate cribs.

20. The method of claim 19, wherein a rail of the separate stationary crib side sections is secured to the crib legs with one of a bolt, nail, screw and bracket.

21. The method of claim 19 further comprising:

positioning a respective mattress over each base to provide a cushioned sleeping area for an infant.

* * * * *